United States Patent [19]

Graff

[11] Patent Number: 4,495,552

[45] Date of Patent: Jan. 22, 1985

[54] FORWARD SHINING VEHICLE LAMP

[75] Inventor: Henry W. Graff, Elgin, Ill.

[73] Assignee: Cal Custom Accessories, Inc., Carson, Calif.

[21] Appl. No.: 448,935

[22] Filed: Dec. 13, 1982

[51] Int. Cl.[3] ..... F21M 3/08

[52] U.S. Cl. ..... 362/297; 362/61; 362/346; 362/347; 362/348; 362/360; 362/361; 362/362

[58] Field of Search ..... 362/297, 215, 304, 310, 362/346, 347, 348, 350, 360, 361, 362, 61

[56] References Cited

U.S. PATENT DOCUMENTS 4,351,018 9/1982 Fratty ..... 362/304

*Primary Examiner*—Donald F. Walsh

*Attorney, Agent, or Firm*—Lockwood, Alex, Fitzgibbon & Cummings

[57] ABSTRACT

A lamp is provided for use on vehicles, which lamp is of the type wherein the light rays are projected forwardly in a predetermined pattern. The predetermined pattern is generated by virtue of a generally continuous grid of the reflector within the lamp, and the lamp does not need a prismatic lens system at the location where the light rays eminate from the lamp.

10 Claims, 15 Drawing Figures

FIG. 7
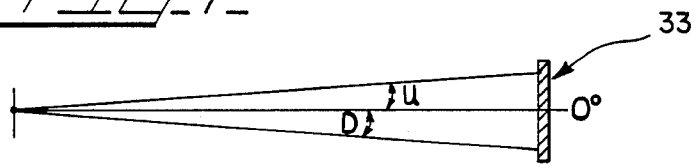
FIG. 8
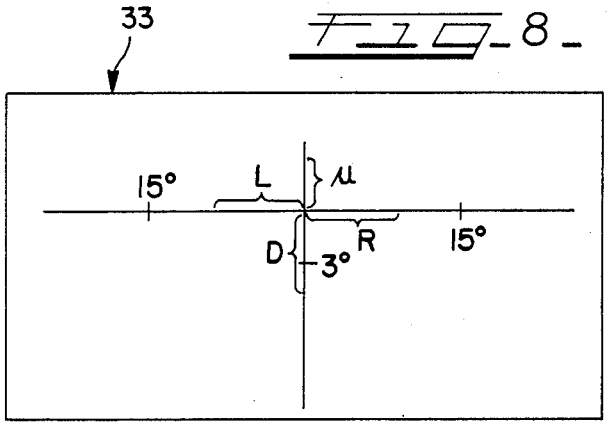
FIG. 9
| CANDLEPOWER AT DEGREES LEFT ON THE TARGET | | | | | | | | | | | | | | | | | | |
|---|---|---|---|---|---|---|---|---|---|---|---|---|---|---|---|---|---|---|
| TOTAL CP | 15° | 14° | 13° | 12° | 11° | 10° | 9° | 8° | 7° | 6° | 5° | 4° | 3° | 2° | 1° | 0° | | CANDLEPOWER AT DEGREES DOWN |
| 5750 CP | 50 CP | 100 CP | 150 CP | 200 CP | 250 CP | 300 CP | 350 CP | 400 CP | 450 CP | 500 CP | 500 CP | 500 CP | 500 CP | 500 CP | 500 CP | 500 CP | 1° | |
| 22450 CP | 700 | 750 | 800 | 850 | 900 | 950 | MIN 1000 | 1167 | 1333 | 1500 | 1667 | 1833 | MIN 2000 | 2167 | 2333 | 2500 CP | 1½° | |
| 24300 CP | 800 | 867 | 933 | 1000 | 1067 | 1133 | 1200 | 1345 | 1489 | 1633 | 1778 | 1922 | 2067 | 2211 | 2356 | 2500 CP | 2° | |
| 26150 CP | 900 | 983 | 1067 | 1150 | 1233 | 1317 | 1400 | 1522 | 1644 | 1767 | 1889 | 2011 | 2133 | 2256 | 2378 | 2500 CP | 2½° | |
| 28000 CP | MIN 1000 | 1100 | 1200 | 1300 | 1400 | 1500 | 1600 | 1700 | 1800 | 1900 | 2000 | 2100 | 2200 | 2300 | 2400 | 2500 CP | 3° | |
| 24360 CP | 870 | 957 | 1044 | 1131 | 1218 | 1305 | 1392 | 1479 | 1566 | 1653 | 1740 | 1827 | 1914 | 2001 | 2088 | 2175 CP | 3½° | |
| 21000 CP | 750 | 825 | 900 | 975 | 1050 | 1125 | 1200 | 1275 | 1350 | 1425 | 1500 | 1575 | 1650 | 1725 | 1800 | 1875 CP | 4° | |
| 10504 CP | 375 | 413 | 450 | 488 | 525 | 563 | 600 | 638 | 675 | 713 | 750 | 788 | 825 | 863 | 900 | 938 CP | 4½° | |

FIG. 10

| PERCENT CANDLEPOWER AT DEGREES LEFT ON THE TARGET | | | | | | | | | | | | | | | | | |
|---|---|---|---|---|---|---|---|---|---|---|---|---|---|---|---|---|---|
| | 15° | 14° | 13° | 12° | 11° | 10° | 9° | 8° | 7° | 6° | 5° | 4° | 3° | 2° | 1° | 0° | |
| 3.48 % | % .03 | % .06 | % .09 | % .12 | % .15 | % .18 | % .22 | % .25 | % .27 | % .30 | % .30 | % .30 | % .30 | % .30 | % .30 | % .30 | 1° |
| 13.81% | .43 | .46 | .49 | .52 | .55 | .58 | .62 | .72 | .82 | .92 | 1.03 | 1.13 | 1.23 | 1.33 | 1.44 | % 1.54 | 1½° |
| 14.95% | .49 | .53 | .57 | .62 | .66 | .70 | .74 | .83 | .92 | 1.0 | 1.09 | 1.18 | 1.27 | 1.36 | 1.45 | % 1.54 | 2° |
| 16.09% | .55 | .60 | .66 | .71 | .76 | .81 | .86 | .94 | 1.01 | 1.09 | 1.16 | 1.24 | 1.31 | 1.39 | 1.46 | % 1.54 | 2½° |
| 17.24 % | .62 | .68 | .74 | .80 | .86 | .92 | .98 | 1.05 | 1.11 | 1.17 | 1.23 | 1.29 | 1.35 | 1.42 | 1.48 | % 1.54 | 3° |
| 14.99% | .54 | .59 | .64 | .70 | .75 | .80 | .86 | .91 | .96 | 1.02 | 1.07 | 1.12 | 1.18 | 1.23 | 1.28 | % 134 | 3½° |
| 12.92% | .46 | .51 | .55 | .60 | .65 | .69 | .74 | .78 | .83 | .88 | .92 | .97 | 1.02 | 1.06 | 1.11 | % 1.15 | 4° |
| 6.46% | .23 | .25 | .28 | .30 | .32 | .35 | .37 | .39 | .42 | .44 | .46 | .48 | .51 | .53 | .55 | % .58 | 4½° |
| 99.92% | | | | | | | | | | | | | | | | | |

PERCENT CANDLEPOWER A DEGREES DOWN

FIG. 11

| LIGHT SOURCE CANDLEPOWER AT HORIZONTAL / VERTICAL LOCATIONS | | | | | | | | | | | |
|---|---|---|---|---|---|---|---|---|---|---|---|
| | | 80-90° | 70-80° | 60-70° | 50-60° | 40-50° | 30-40° | 20-30° | 10-20° | 5-10° | |
| 1.04 % | 850.9CP | 109.4CP | 116.5CP | 124.3CP | 117.9CP | 109.3CP | 96.4CP | 83.5CP | 66.8CP | 26.8CP | 4½° |
| 1.04 % | 852.9 | 110.6 | 118 | 124.3 | 117.9 | 109.2 | 96.2 | 83.3 | 66.7 | 26.7 | 4° |
| 1.04% | 854.9 | 111.8 | 119.5 | 124.3 | 117.9 | 109.1 | 96 | 83.1 | 66.6 | 26.6 | 3½° |
| 1.04% | 855.9 | 112 | 121 | 124.3 | 117.9 | 109 | 95.8 | 82.9 | 66.5 | 26.5 | 3° |
| 1.04% | 857.4 | 113.2 | 122.5 | 124.3 | 117.9 | 108.9 | 95.6 | 82.7 | 66.4 | 26.4 | 2½° |
| 1.05% | 859.8 | 114.3 | 124 | 124.3 | 117.9 | 108.8 | 95.4 | 82.5 | 66.3 | 26.3 | 2° |
| 1.05% | 861.45 | 115.5 | 125.1 | 124.3 | 117.9 | 108.7 | 95.2 | 82.3 | 66.2 | 26.25 | 1½° |
| 1.05% | 864 | 117.1 | 126.7 | 124.3 | 117.9 | 108.6 | 95 | 82.1 | 66.1 | 26.2 | 1° |
| 1.05% | 864 | 117.1 | 126.7 | 124.3 | 117.9 | 108.6 | 95 | 82.1 | 66.1 | 26.2 | ½° |
| 1.05% | 862.25 | 116.9 | 126.4 | 124.3 | 117.9 | 108.4 | 94.6 | 81.8 | 65.9 | 26.05 | 0° |
| 1.06% | 866.5 | 116.8 | 126.2 | 124.2 | 118 | 108.8 | 95.3 | 82.8 | 67.4 | 27 | ½° |
| 1.06% | 864 | 116.8 | 126.2 | 124.2 | 118 | 108.8 | 95.3 | 82.8 | 67.4 | 27 | 1° |
| 1.06% | 869.25 | 116.7 | 126.1 | 124.2 | 119.2 | 110 | 95.7 | 83.2 | 68.10 | 26.05 | 1½° |
| 1.07% | 882.35 | 110.9 | 119.8 | 124.2 | 125.2 | 115.5 | 100.49 | 87.4 | 71.5 | 27.36 | 2° |
| 1.08% | 885.8 | 110.8 | 119.6 | 124.2 | 127.4 | 116.7 | 100.9 | 87.9 | 72.3 | 26 | 2½° |
| 1.08% | 888.6 | 110.7 | 119.4 | 124.2 | 128.6 | 117.9 | 101.3 | 88.4 | 73.1 | 25 | 3° |
| 1.1% | 891.4 | 110.6 | 119.2 | 124.2 | 129.8 | 119.1 | 101.7 | 88.9 | 73.9 | 24 | 3½° |
| 1.1% | 894.2 | 110.5 | 119 | 124.2 | 131 | 120.3 | 102.1 | 89.4 | 74.7 | 23 | 4° |
| 1.1% | 897.6 | 110.4 | 118.8 | 124.2 | 132.8 | 121.5 | 102.5 | 89.9 | 75.5 | 22 | 4½° |

FIG. 12

| 1 | 2 | 3 | 4 | 5 | 6 |
|---|---|---|---|---|---|
| 0° | 1.54% | 5–19° | 1.601% | 12° | 6° |
| 1° | 1.46% | 20–29° | 1.506% | 24.5° | 12.75° |
| 2° | 1.39% | 30–37° | 1.393% | 33.5° | 17.75° |
| 3° | 1.31% | 38–44° | 1.344% | 41° | 22° |
| 4° | 1.24% | 45–50° | 1.219% | 47.5° | 25.75° |
| 5° | 1.16% | 51–55° | 1.104% | 53° | 29° |
| 6° | 1.09% | 56–60° | 1.104% | 58° | 32° |
| 7° | 1.01% | 61–65° | 1.133% | 63° | 35° |
| 8° | .94% | 66–69° | .906% | 67.5° | 37.95° |
| 9° | .86% | 70–73° | .902% | 71.5° | 40.25° |
| 10° | .81% | 74–77° | .900% | 75.5° | 42.75° |
| 11° | .76% | 78–80° | .675% | 79° | 45° |
| 12° | .71% | 81–83° | .625% | 82° | 47° |
| 13° | .66% | 84–86° | .625% | 85° | 49° |
| 14° | .60% | 87–88° | .418% | 87.5° | 50.75° |
| 15° | .55% | 88–90° | .418% | 89.5° | 52.25° |

FIG. 13

| PERCENTAGE CANDLEPOWER FROM REFLECTOR AT HORIZONTAL/VERTICAL LOCATION | | | | | | | | | |
|---|---|---|---|---|---|---|---|---|---|
| 80–90° | 70–80° | 60–70° | 50–60° | 40–50° | 30–40° | 20–30° | 10–20° | 5–10° | |
| .136% | .146% | .151% | .144% | .133% | .117% | .101% | .081% | .032% | 3½° |
| .136 | .147 | .151 | .144 | .133 | .117 | .101 | .081 | .032 | 3° |
| .138 | .149 | .151 | .144 | .133 | .116 | .101 | .081 | .032 | 2½° |
| .139 | .151 | .151 | .144 | .133 | .116 | .1 | .081 | .032 | 2° |
| .141 | .152 | .151 | .144 | .132 | .116 | .1 | .081 | .032 | 1½° |
| .143 | .154 | .151 | .144 | .132 | .116 | .1 | .081 | .032 | 1° |
| .143 | .154 | .151 | .144 | .132 | .116 | .1 | .081 | .032 | ½° |
| .142 | .154 | .151 | .144 | .132 | .115 | .1 | .080 | .032 | 0° |
| .142 | .154 | .151 | .144 | .133 | .116 | .101 | .082 | .033 | ½° |
| .142 | .154 | .151 | .144 | .133 | .116 | .101 | .082 | .033 | 1° |
| .142 | .154 | .151 | .145 | .134 | .117 | .101 | .083 | .032 | 1½° |
| .135 | .146 | .151 | .152 | .141 | .122 | .106 | .087 | .033 | 2° |
| .135 | .146 | .151 | .155 | .142 | .123 | .107 | .088 | .032 | 2½° |
| .135 | .145 | .151 | .157 | .144 | .123 | .108 | .089 | .030 | 3° |
| .135 | .145 | .151 | .158 | .145 | .124 | .108 | .090 | .029 | 3½° |
| 2.084%+ | 2.251%+ | 2.265%+ | 2.207%+ | 2.032%+ | 1.77%+ | 1.535%+ | 1.248%+ | .478% | |

=15.88%

FORWARD SHINING VEHICLE LAMP

BACKGROUND AND DESCRIPTION OF THE INVENTION

This invention relates generally to lamps for vehicles, more particularly to vehicle lamps that project light rays within a predetermined pattern by reflecting them off of a specially designed grid-like reflector within the lamp. In its preferred embodiment, the lamp projects a pattern having its maximum intensity generally below horizontal, without needing a specially designed multi-prismatic lens system at the locations where the light rays leave the lamp.

Vehicle lamps that emit their light in a predetermined pattern concentrated below horizontal are wellknown as sealed beam headlamps, fog lights, running lights and the like. Sometimes these are provided with opaque or translucent shades or visors at their upper portions in order to minimize directing the most intense rays from the filament into the eyes of drivers of other vehicles. Such shades or visors are, however, generally wasteful of light energy. A typical and exceedingly popular manner of directing light rays into such a predetermined pattern without needing such shades or visors utilizes a lamp lens having a pattern of numerous different individually selected, precisely positioned prisms for directing the light rays into the predetermined projecting pattern, usually in accordance with governmental or industry guidelines, such as the standards published by the Society of Automotive Engineers (SAE).

Lenses of this type having a multitude of differently wedged and precisely positioned lens prisms are constructed by selecting and positioning each individual prism on a trial-and-error basis whereby a plurality of numerous prisms are tested on a one-by-one basis for providing the desired light pattern and intensity for a single, small location while the rest of the lens area is masked off. This procedure is continued by selecting a prism for each small location until the entire lens pattern is determined. For example, if according to a governmental or industry standard, a section of a light beam eminating from a lamp can emit only a certain maximum candela or candlepower, the light from the filament must be directed by the individual lens prisms in such a manner that the section of light does not exceed that maximum amount. Additionally, there is a substantial amount of interaction with respect to light rays passing through the respective various individual prisms. Currently, such interactions are taken into account and compensated for by the experienced work of a skilled artisan proceeding in a generally trial- and-error manner. Moreover, multi-prismed lamp lenses characteristic of a typical so-called sealed-beam vehicle headlamp are relatively expensive, and the lens must be properly positioned with respect to the lamp filament in order that the light rays might be properly directed to fall within the standards.

It is accordingly desirable if a forward shining vehicle lamp could be provided which projects the light according to required standards without the need for a multi-prismed lens, particularly if same can be provided in a manner that substantially eliminates trial-and-error procedures.

The present invention provides a vehicle lamp which emits light rays in a predetermined pattern consistent with standards requirements by including a reflector within the lamp that includes a generally continuous grid and overall shape that reflects the light out of the lamp in a predetermined pattern that meets standards requirements. Moreover, the generally continuous grid and shape of this reflector is generated by a step-by-step method that eliminates trial-and-error procedures. This step-by-step method is capable of being automated whereby the generally continuous grid reflector is produced with the assistance of a computer-guided molding device. If desired, the generally continuous grid reflector may be made by first properly shaping and forming a generally non-reflective resin or polymer, after which the formed grid is rendered reflective by plating a highly reflective surface thereover. The generally continuous grid reflector according to this invention includes a plurality of grid sections that combine with each other in order to reflect light eminating from the lamp filament in the desired standards pattern.

It is accordingly a general object of the present invention to provide an improved vehicle lamp.

Another object of this invention is an improved vehicle lamp which projects its light in a predetermined forward-shining pattern without the need for a multi-prismed lens.

Another object of the present invention is an improved vehicle lamp having a generally continuous grid reflector that reflects light eminating from the lamp filament to provide a light projection pattern in accordance with governmental or industry standards.

Another object of the present invention is an improved method for providing a vehicle lamp meeting governmental or industry standards without needing to rely on trial-and-error procedures.

These and other objects of this invention will become apparent from the following detailed description, taken in conjunction with the accompanying drawings, wherein:

FIG. 7 is a sketch illustrating vertical angular measurements of optical paths from a light source to its target;

FIG. 8 is a sketch illustrating a typical target indicating angular measurements of horizontal and vertical components of a projected light source;

FIG. 9 is a chart of exemplary candlepower requirements at spaced horizontal and vertical locations on an S.A.E. target;

Figure 1:
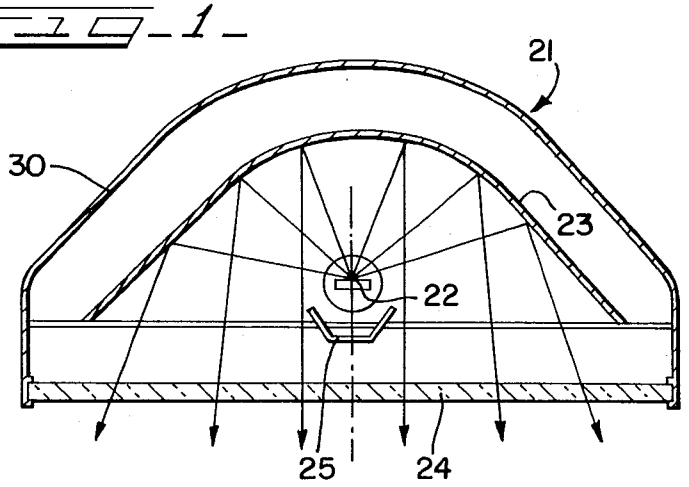
FIG. 1 is a generally horizontal sectional view through a lamp according to this invention.
Figure 3:
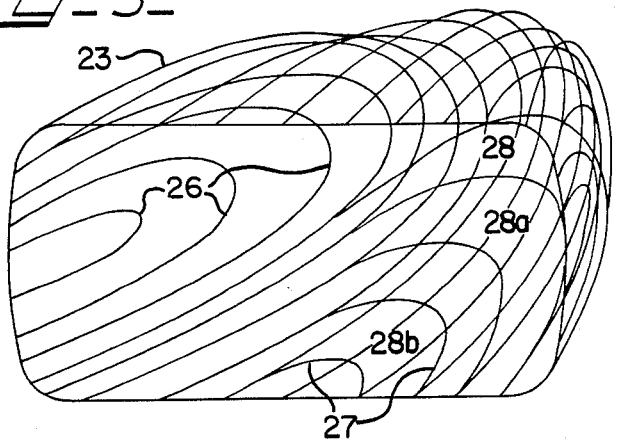
FIG. 3 is a perspective illustration of a reflector in accordance with this invention, illustrating a plurality of generally vertical reflector boundaries and generally horizontal reflector boundaries that underlie the overall reflector configuration.
Figure 14:
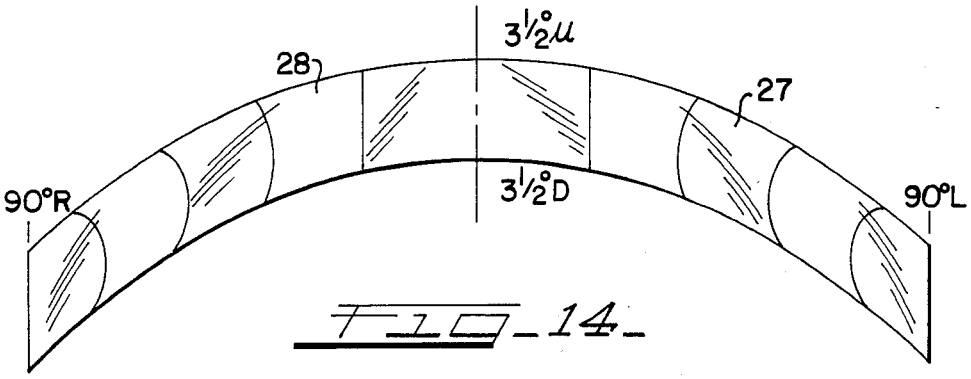
Figure 15:
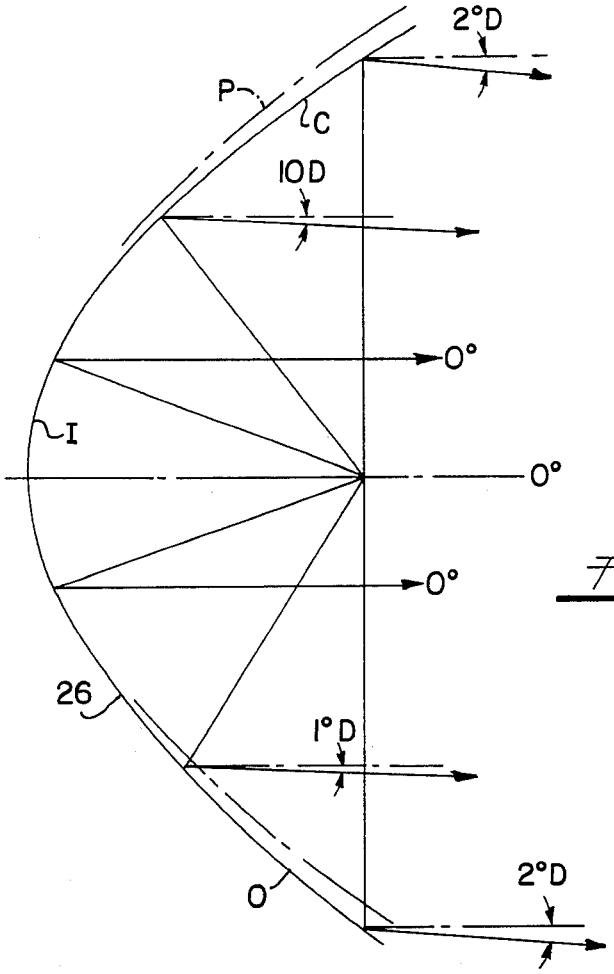

FIG. 10 is a chart of the target candlepower requirements shown in FIG. 9, expressed as a percent of the total candlepower requirement between 0 and 15° left on the horizontal axis and between 1 and 4½° down on the vertical axis;

FIG. 11 is a chart of candlepower provided by a typical light source for a lamp of the type shown in FIG. 1, the candlepower being reported at spaced locations designated as between 5 and 90° left on the horizontal axis and between 4½° up and 4½° down on the vertical axis;

FIG. 12 is a chart of the source candlepower values of FIG. 11, expressing same as a percentage of the total available output of the light source;

FIG. 13 is a chart illustrating the location and angular orientation of segments of a horizontal backbone of the reflector shown in FIG. 1 that directs the candlepower of its light source in a manner that provides the directed candlepower requirements onto the target;

FIG. 14 is a perspective illustration of a horizontally oriented backbone section of a reflector as illustrated in FIG. 3; and FIG. 15 is an illustration of a vertical section through the reflector of FIG. 3, showing a plurality of light rays reflected therefrom.

The forward shining vehicle lamp according to this invention, generally designated as 21 in FIG. 1, includes a light source 22, which will typically include a filament from which the light energy is emitted. Lamp 21 further includes a continuous grid reflector member 23. The lamp 21 typically also further includes a dust shield 24 which is a transparent protective device that need not include any type of lens system or prismatic areas. Usually, the lamp 21 will include a light shield 25 in front of the light source 22 for masking off forwardly directed light that would not be reflected off of the reflector member 23. In most cases, the lamp will include a housing 30 that serves to secure in place and protect all of the other elements of the lamp 21. The light source 22 is securely mounted with respect to the reflector member 23 in order to maintain a predetermined relative location between the light source 22 and the reflector member 23.

Figure 4:
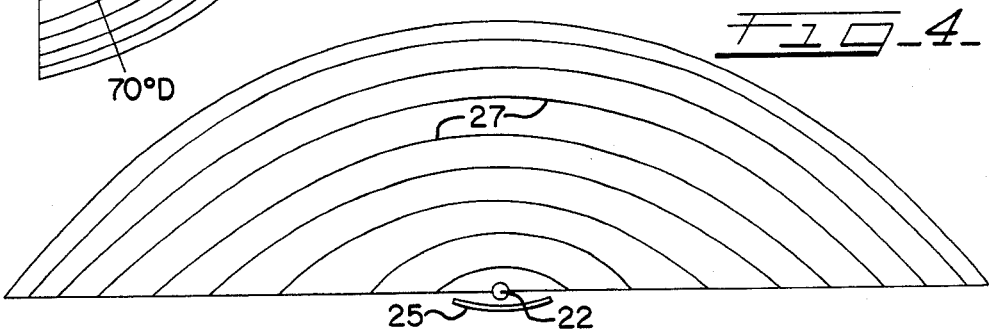
FIG. 4 is a generally schematic plan view of FIG. 3, illustrating the generally horizontal reflector boundaries.

The continuous grid structure of the reflector member 23 is illustrated in FIG. 3 as including a plurality of spaced horizontal curves 27. The configuration of one of these horizontal curves 27 is shown more particularly in FIG. 4, while the plurality of spaced vertical curves are more particularly illustrated in FIG. 5. As generally shown in FIG. 3, these vertical curves 26 and horizontal curves 27 intersect with each other in order to form a plurality of reflective grid sections 28, 28*a*, 28*b* and so forth. Typically, each such grid section 28, 28*a*, 28*b* and so forth is of a configuration and structure that is different from that of most of the other grid sections. Each such grid section 28, 28*a*, 28*b* and so forth is generally concave both in horizontal cross-section and in vertical cross section, same being of a generally dish-shaped configuration. In the interest of clarity, several spaced horizontal curves 27 have been omitted from FIG. 3, as have been numerous grid sections 28 which would be formed by the intersection of these omitted spaced horizontal curves with respective ones of the spaced vertical curves 26.

Figure 6:
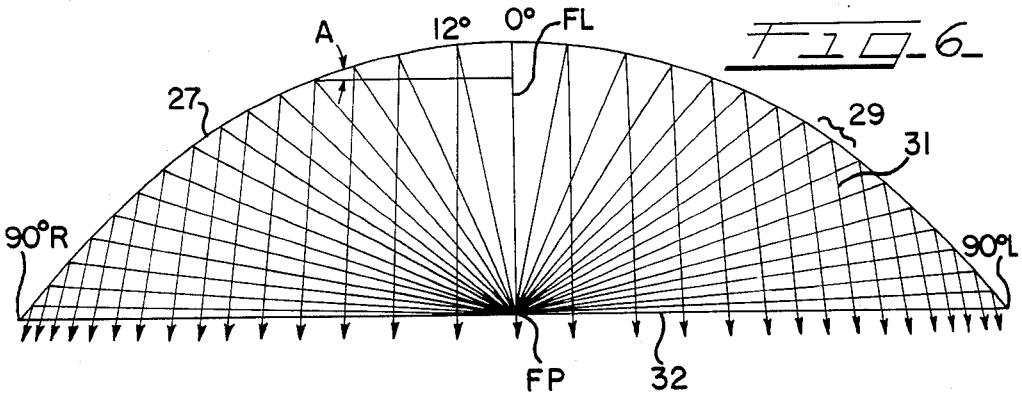
FIG. 6 is an illustration of a horizontal section through the reflector of FIG. 3, showing a plurality of light rays reflected therefrom.

FIG. 6 is useful in connection with a more detailed description of the spaced horizontal curves 27. Particularly illustrated is the horizontal curve that is used to define the backbone of the reflector 23. Each such curve 27 is actually a reflector profile of adjacent segments 29 that are connected in end-to-end relationship in order to define the generally continuous curve 27. A plurality of light rays 31 are generally illustrated as reflecting from the approximate midpoint of each segment 29.

Each segment 29 has a configuration that is defined by a plurality of steps which ultimately determine the segment length and the angle of each such segment 29 with respect to the axis of the reflector member 23, one component of each such angle being parallel to a plane 32 of the open mouth of the reflector member 23. In essence, the method determines the amount and direction of candlepower from the light source 22 that is needed to flood a preselected portion of a target 33 in order to meet a governmental or industry standard. The angular orientation and length of each segment 29, when used to define the horizontal extent and shape of each grid section 28, is determined in terms of such required candlepower for a portion of the target 33, which is spaced from the light source 22 by a distance that is specified by particular governmental or industrial specifications that are being followed, and the candlepower values required from the light source 22 are determined by known calculations from light meter measurements made at the target 33.

Figure 2:
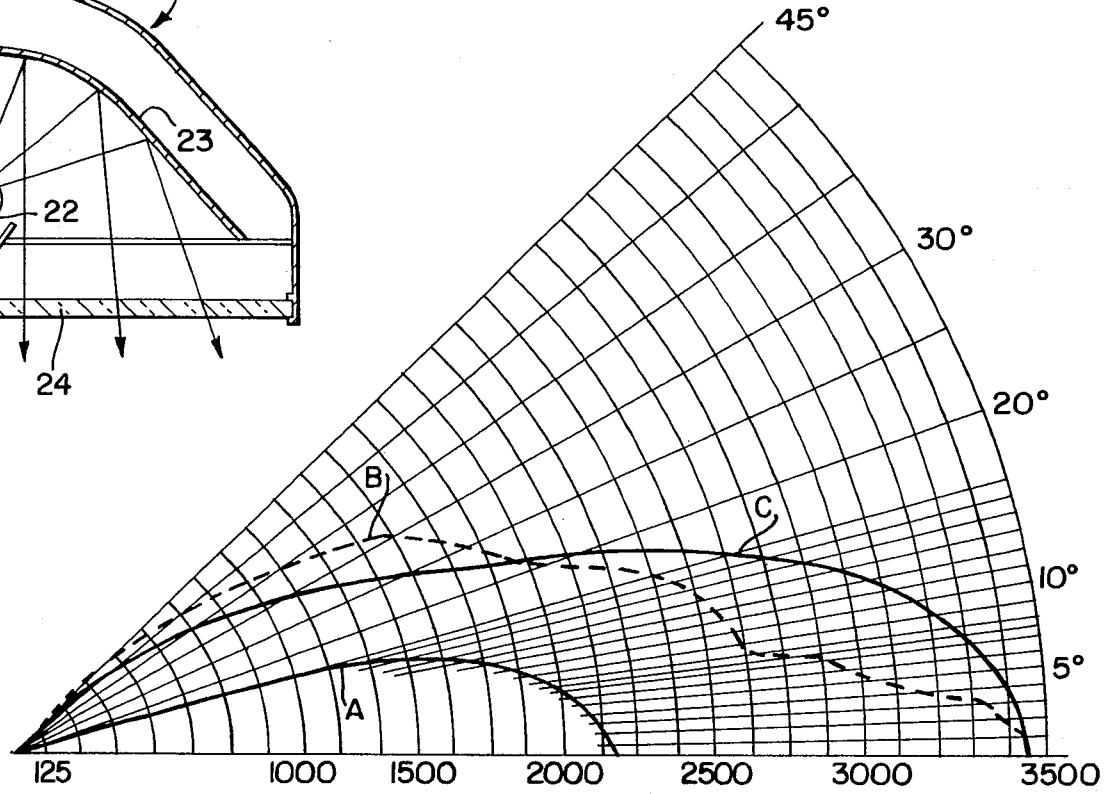
FIG. 2 is a polar coordinate plot of candlepower output curves of some forward shining lamps on a horizontal line passing through the location requiring the greatest candlepower reading.

With more particular reference to the method of determining the configuration, size and location of each segment 29, a light source 22 is selected such that it possesses adequate candlepower to flood the target 33 in accordance with the specifications of the standard being used. For example, FIG. 2 illustrates candlepower output curves on a horizontal line passing through the point on the target 33 requiring the highest candlepower reading, the plot being on a chart of polar coordinates, which is somewhat representative of the light pattern coming from a lamp. Curve A represents the minimum candlepower needed to meet a particular industry standard. Line B represents ½ of the candlepower produced by a currently manufactured lamp, and curve C represents the ideal candlepower curve that would represent that of the lamp 21.

Usually, the standard being used provides candlepower requirements at only a relatively few locations on the target, and this step will preferably include extrapolating candlepower requirements in increments that are more closely and more uniformly spaced than those provided by the standard. Measurements of this character are made in terms of angles from the horizontal and vertical center, or axis, of the target measured along a line eminating from the light source as illustrated in FIGS. 7 and 8. Angle U designates an angular measurement above horizontal, or the abscissa 34 at 0°, this being a vertical angular measurement referred to herein as "° up". Angle D designates an angular measurement below horizontal, referred to herein as "° down". Representations of these angular measurements are illustrated in FIG. 8, as are the horizontal designations of an angle L, or "° left" of the ordinate 35, and angle R, or "° right" of the ordinate 35.

Preferably, the extrapolations of minimum candlepower requirements on the target 33 should extend somewhat beyond the angular positions specified by the standard being used. For example, a typical standard may specify requirements between 15° left and 15° right as illustrated in FIG. 10, and the extrapolations should be made beyond these limits, for example between 17° left and 17° right. Similarly, a typical vertical standard specification for minimum candlepower requirements is designated at between 0 and 3° down, and the vertical extrapolation can extend somewhat beyond those limits. FIG. 9 charts an exemplary set of candlepower requirements at the target 33. Exemplary S.A.E. standards are contained within the heavily lined blocks, while the remaining blocks show extrapolated candlepower requirements.

It should be noted that, in FIG. 9, the horizontal increments are at a 1° spacing, while the vertical increments are at a ½ spacing. Generally speaking, the candlepower minimum requirements are greater in the horizontal direction than in the vertical direction, and a smaller increment is needed in the vertical direction than in the horizontal direction in order to provide an adequate number of increments within the narrower vertical limits.

By the next step of the method, the candlepower requirements at the target 33 are expressed as a percentage of candlepower required at horizontal and vertical positions on the target 33, which is illustrated in FIG. 10.

Figure 5:
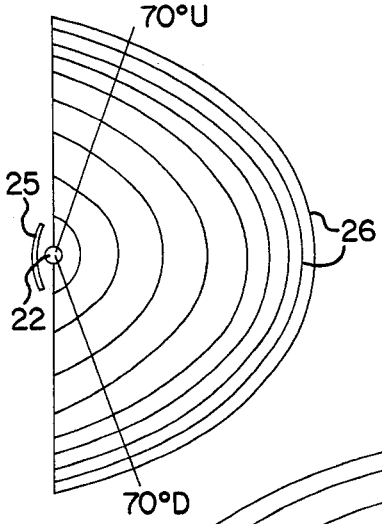
FIG. 5 is a generally schematic elevational view of FIG. 3 illustrating the generally vertical reflector boundaries.

Another step in this method is to chart the candlepower emitted from the light source 22 in the directions that the light would strike the reflector 23. Typically, this will be at an angle of between 90° left and 90° right on the reflector axis, as measured in FIG. 6 facing in the direction toward the target, and between 70° up and 70° down of the reflector axis of the illustrated rectangularly shaped lamp 21, as illustrated in FIG. 5. When the lamp has a circular configuration (not shown), the vertical extent will typically be between 90° up and 90° down. In many lamps 21, particularly rectangularly shaped lamps, a certain amount of vertically directed light is lost or wasted because it is not reflected forwardly, which is a reason for measuring light emitted from the bulb between only 70° up and 70° down for the illustrated lamp 21, rather than through a larger angular extent. Starting from the known candlepower of the light source 22, this amount is reduced firstly to account for the efficiency of a typical reflective surface (which surfaces are typically about 70% efficient) and secondly to subtract the amount of light lost by the structure needed to mount the light source 22. An examplary chart for a typical light source 22 is shown in FIG. 11.

FIG. 11 shows measured candlepower values from a typical light source 22 having a total available candlepower of 82099 CP. For example, at 4½° up as measured on FIG. 5, the candlepower at from 5° left to 10° left as measured on FIG. 6 is 26.8 CP. From 10° left to 20° left, it is 66.8 CP. More particularly, the 26.8 CP reading is at 7½° left, which is midway between 5° left and 10° left, and the 66.8 CP reading is at 15° left, which is midway between 10° left and 20° left. Readings are continued in this manner to cover from 5° left to 90° left through a vertical segment of 9°. The vertical extent of the segment is selected so as to measure values that are in excess of the total candlepower required at the target 33 for a particular grid section 28. This procedure is continued to measure total candlepower at increments of ½° up through ½° down for a full 90° left, and each such total candlepower value is expressed as a percentage of the total available candlepower of the light source 22. For example, in FIG. 11, the total candlepower emitted from this light source 22 at 4½° up from between 0 and 90° left is 850.9 CP, which is 1.04% of the total candlepower available from the light source 22.

At this stage of the method, there has been provided a chart of percentage values for light emitted from the light source 22 and reflected by the reflector 23, as well as a chart of the percentage candlepower that is required for flooding the target 33. The next step of the method is to combine these two percentages in order to define the size and orientation of each segment 29 of the horizontal curves. More particularly, from these percentages, it is possible to determine the placement angle of each horizontal segment 29 of the horizontal curve 27 in order to define the horizontal curve 27 and the backbone defined thereby in conjunction with a portion of the vertical curve 26.

FIG. 13 reports the candlepower output from the light source 22 in terms of the percentage of total available output at selected coordinates. For example, at 3½° up and 7½° left (representing the average value at from 5° left to 10° left), 0.32% of the candlepower is emitted in this direction.

For a typical lamp 21, the brightest spot or greatest candlepower thereof is traditionally designed to be projected onto the target 33 at approximately 2½° down. By the same token, in a typical lamp 21, the brightest spot on the reflector 23 in the vertical direction is at about 0°, with approximately 50% of the total light being above 0° on the reflector 23, with the other 50% being below 0° on the reflector 23. Thus, the approximate brightest spot is at 2½° down on the target 33 while it is at 0° on the reflector 23, and these two locations are coordinated by this method such that the brightest spot on the target 33 will be at 2½° down when reflector light hits same.

It is also necessary to determine how much light from the reflector 23 is needed to fulfill target needs. The candlepower at 2½° down, and from 0° to 15° left in the horizontal direction, on the target 33 shown on FIG. 10 is 16.09% of the light required on the target 33, while that at 0° in the vertical direction, and from 5° left to 90° left in the horizontal direction, on the reflector 23 is 1.05% from the reflector or light source 22 as shown on FIG. 11. Accordingly, this candlepower provided by the light source 22 is not of itself adequate to provide the 16.09% of light required on the target 33, and it is necessary to expand the reflector area in the vertical direction in order to provide the needed 16.09% of the candlepower to the target at 2½° down and 0° horizontal. When, as shown in FIG. 13, candlepower is provided from 3½° up through 3½° down, and from 5° left to 90° left, on the reflector 23, a total of 15.88% of the candlepower is provided, which very closely approximates the 16.09% required at the target 33. Thus, the vertical extent of the grid section 28 needed to provide the candlepower required at 2½° down on the target has an angular height of 7°, from 3½° up to 3½° down.

As a step in determining the angular orientation and length of the grid section 28, reference is made to FIG. 12. The first column of FIG. 12 is the percent candlepower at degrees from the axis of the target 33, and the second column is the percent of light required at the previously selected 2½° down on the target 33, these data being taken from FIG. 10. In other words, at 0° horizontal on the target 33, it is necessary to provide a total of b 1.54% of the candlepower. This candlepower will be provided if an adequate amount of the horizontal area of the reflector is used to direct light at that location. The extent of that horizontal amount is determined by referring to FIG. 13.

As indicated in FIG. 13, when the area bounded by 3½° up, 3½° down, 5° left and 10° left of the reflector is utilized, the light source provides 0.478% of the light, and additional area must be utilized in order to provide the required 1.54% of candlepower to the target 33. If this area on the reflector were expanded to 3½° up, 3½° down and 5° left to 20° left the total candlepower provided off of the reflector 23 would be 0.478% plus 1.248%, or 1.726%, which is in excess of that needed. Thus, the area of reflector 23 needed will extend to something less than 20° left. The area of from 10° to 20° covers a total of 10°, and each degree between 10° and 20° horizontal accounts for 0.124% of the candlepower on the average. By adding increments of this amount to the 0.478% provided by the 5° to 10° horizontal area, it is determined that a total of 1.601% is provided when the area extends to 19° from the axis in the horizontal direction. Accordingly, the third column of FIG. 12 designates a horizontal extent for a grid section 28 on the reflector 23 of from 5° to 19°, which provides 1.601% of the candlepower.

For simplicity, the horizontal extent of from 5° to 19° from the reflector axis in the horizontal direction is represented by its midpoint or average angle of 12°. The reflector angle, which is illustrated as angle A in FIG. 6 and which is the angle that the horizontal curve portion of the grid section 28 makes with the axis of the reflector, is one half of the sum of the midpoint angle in column 5 of FIG. 12 and the target angle in column 1 of FIG. 12. Reflector angles thus determined are specified in column 6 of FIG. 12.

Information contained in FIG. 12 is utilized to construct the backbone graphically. A focal point (FP) is positioned as illustrated in FIG. 6, an ordinate is drawn therethrough corresponding to the 0° horizontal, and an abscissa is drawn through the focal point and 90° from the ordinate. The various midpoint or average angles shown in column 5 of FIG. 12 are drawn through the point FP. Each initial reference angle from column 3 of FIG. 12 is also sketched in, these angles being 5°, 20°, 30°, 38°, 45°, 51°, and so forth, through 89°. The segments 29 will each be drawn between consecutive ones of these reference angles. Preferably, the first segment 29 thus drawn will be between 90° and 89°, same being drawn at an angle of 52.25°, such being the reflector angle from column 6 of FIG. 12. The next segment 29 is drawn between 87° and 84°, at a reflector angle of 50.75°, and this procedure is continued until the entire horizontal curve 27 is defined.

The horizontal curve represented in FIG. 6 is actually of a vertical length from between 3½° up and 3½° down along a generally parabolic path. Although a series of sections 28 are illustrated in FIGS. 3 and 14, it is desirable to make the transitions between adjacent grid sections 28 as smooth as possible. This is best accomplished by defining additional points along the horizontal curve 27 so as to define smaller grid sections 28.

This procedure is then repeated in order to generate another horizontal curve 27 at a location above and below the previously generated curve and so forth, until the entire grid reflector 23 has been generated with FIG. 14 representing the backbone structure of the reflector 23.

With more particular reference to the vertical curves 26, each is generally parabolic in shape, preferably with an orientation that is skewed generally downwardly with respect to the axis of the reflector 23. Such a skewed orientation is illustrated in FIG. 15 wherein line P, in phantom, is of a true parabolic shape. The vertical curve 26 includes an interior position I which corresponds to the parabolic curve P, an upper portion C which is skewed in a closed direction, and a lower portion O which is skewed in the open direction. More particularly, in order to assist in having the projection of the lamp 21 be toward a line that is below horizontal, portion C is defined by reorienting the parabolic curve P downwardly in selected increments.

For example, the section of curve 26 from 0° to 3½° up can be truly parabolic, the section of curve from 3½° up and 7° up can be skewed from true parabolic by 1° toward the axis or generally downwardly, the section of curve from 7° up to 10½° up can be skewed from true parabolic by 2° toward the axis or generally downwardly, and so forth. Continuing the example, the section of curve 26 from 0° to 3½° down can be truly parabolic, the section of curve from 3½° down to 7° down can be skewed from true parabolic by 1° away from the axis or generally downwardly, the section of curve from 7° down to 10½° down can be skewed from true parabolic by 2° away from the axis or generally downwardly and so forth.

Once the completed configuration of the reflector 23 has been determined, it is possible, if necessary, to proportionally enlarge or reduce the size of the reflector 23 without revising the shape and orientation of the curves thereof. Such might be necessary when the initially constructed reflector is too large or too small for the particular lamp within which same is to be installed or when the focal length is to be varied. In this instance, the focal length referred to is designated as line FL on FIG. 6, which extends from the focal point FP to the 0° horizontal and 0° vertical point on the reflector 23.

It will be apparent to those skilled in this art that the present invention can be embodied in various forms; accordingly, this invention is to be construed and limited only by the scope of the appended claims.

What is claimed is:

1. A forward shining vehicle lamp comprising:

a protective housing having an open mouth;

a reflective member mounted to the protective housing, said reflector member having an axis and a generally concave reflective surface that is oriented generally toward the open mouth of the protective housing;

a light source secured to the lamp in predetermined relationship between the reflector member and the open mouth of the protective housing; and said internal generally concave surface of the reflector member has a generally continuous grid structure, said generally continuous grid structure including a plurality of grid sections having a reflective surface, wherein said generally continuous grid structure of the reflector member is defined by a plurality of spaced vertical curves intersecting with a plurality of spaced horizontal curves to define said plurality of grid sections, the reflective surface of each said grid section being generally concave and shaped to reflect light eminating from said light source such that the pattern of light reflected from said generally continuous grid structure substantially conforms to a target pattern that defines a predetermined array of candlepower direction and magnitude.

2. The forward shining vehicle lamp of claim 1, wherein each of said horizontal curves is defined by a plurality of sections connected in end-to-end relationship with each other, each section having a length and an angular orientation with respect to the axis of the reflector member, each said section length and angular orientation providing a surface for reflecting a portion of said light source to provide said array of candlepower direction and magnitude.

3. The forward shining vehicle lamp of claim 1, wherein each of said vertical curves is of a generally parabolic shape, said generally parabolic shape being skewed generally downwardly with respect to the axis of the reflector member.

4. The forward shining vehicle lamp of claim 1, wherein each of said horizontal curves is defined by a plurality of sections connected in end-to-end relationship with each other, each sections having a length and an angular orientation with respect to the axis of the reflector member, each said section length and angular orientation providing a surface for reflecting a portion of said light source to provide said array of candlepower direction and magnitude, and each of said vertical curves is of a generally parabolic shape, said generally parabolic shape being skewed generally downwardly with respect to the axis of the reflector member.

5. The forward shining vehicle lamp of claim 2, wherein the horizontal length of each section is defined by approximately equating a percentage of candlepower provided by an angular measure from the light source with a percentage of candlepower required by the predetermined array of candlepower direction and magnitude.

6. The forward shining vehicle lamp of claim 2, wherein the horizontal length of each section is expressed as an angular distance from the axis of the reflector member and wherein the angular orientation of each section of the horizontal curve is a reflector angle defined as one half of the midpoint of said angular distance horizontal length plus one half of an angle at which said horizontal section of the reflector member directs the light source to the target.

7. The forward shining vehicle lamp of claim 3, wherein said generally downwardly skewed parabolic shape is defined by reorienting a parabolic curve downwardly in selected increments.

8. A method of manufacturing a forward shining vehicle lamp, comprising:

selecting a light source having a candlepower rating that is adequate to flood a target with enough candlepower to meet a standard;

determining the percentage of candlepower emitted from said light source at several angular intervals which will strike a reflector member positioned generally adjacent to the light source;

choosing a target pattern having an array of candlepower direction and magnitude for a forward shining vehicle lamp;

expressing the target pattern candlepower magnitude in terms of percentage of candlepower required at each target pattern directional location;

approximately equating a portion of the percentage of candlepower emitted from the light source and reflected by the reflector member with said candlepower percentage requirement at each target pattern direction location, said approximate equating step being for defining the angular height and length of a generally concave grid section of the reflection member of the vehicle lamp; and defining the angular orientation of each grid section of the reflector member from said angular length and from an angle at which said grid section directs the light source to the target.

9. The method of claim 8, wherein said step of approximately equating a portion of the candlepower percentage from the light source with each said candlepower percentage target requirement includes summing the candlepower percentage provided by one angular interval from the light source with a candlepower percentage provided by an adjacent angular interval and continuing said summing step until the total percentage thereof is approximately equal to the said candlepower percentage target requirement.

10. The method of claim 8, wherein said step of defining the angular orientation of a grid section includes adding one half of an angular midpoint of said angular length to one half of said grid section directing angle.

* * * * *

Disclaimer 4,495,552.—*Henry W. Graff*, Elgin, Ill. FORWARD SHINING VEHICLE LAMP. Patent dated Jan. 22, 1985. Disclaimer filed Mar. 29, 1989, by the assignee, Mr. Gasket Co.

Hereby enters this disclaimer to the entire term of said patent

[ *Official Gazette June* 6, 1989 ]